US005280750A

United States Patent [19]

Yoshida et al.

[11] Patent Number: 5,280,750

[45] Date of Patent: * Jan. 25, 1994

[54] INK FOUNTAIN APPARATUS

[75] Inventors: Kouichi Yoshida, Tokyo; Kenji Kusunoki, Kanagawa, both of Japan

[73] Assignee: Kabushiki Kaisha Tokyo Kikai Seisakusho, Japan

[ * ] Notice: The portion of the term of this patent subsequent to Oct. 25, 2008 has been disclaimed.

[21] Appl. No.: 521,234

[22] Filed: May 9, 1990

[30] Foreign Application Priority Data

May 11, 1989 [JP] Japan ..... 1-116138
May 12, 1989 [JP] Japan ..... 1-117249

[51] Int. Cl.[5] ..... B41F 31/06; B41F 31/20

[52] U.S. Cl. ..... 101/363

[58] Field of Search ..... 101/350, 363, 364, 366, 101/365, 207, 208-210, 148; 118/259, 29

[56] References Cited

U.S. PATENT DOCUMENTS

| | | | |
|---|---|---|---|
| 3,045,592 | 7/1962 | Shearer et al. | 101/364 |
| 3,205,816 | 9/1965 | Heimlicher | 101/366 |
| 4,149,463 | 4/1979 | Kobayashi | 101/366 |
| 4,497,250 | 2/1985 | Dressler | 101/350 |

FOREIGN PATENT DOCUMENTS

| | | | |
|---|---|---|---|
| 3443510 | 6/1986 | Fed. Rep. of Germany | 101/364 |
| 35-12862 | 9/1960 | Japan . | |
| 39-5717 | 4/1964 | Japan . | |
| 169069 | 12/1981 | Japan | 101/364 |
| 59-393 | 1/1984 | Japan . | |

*Primary Examiner*—J. Reed Fisher
*Attorney, Agent, or Firm*—Ronald P. Kananen

[57] ABSTRACT

An ink fountain apparatus in an ink supply system for use with a printing press. The apparatus comprises an ink reservoir provided with an ink fountain, an ink steering/collecting section formed in a zone of the ink reservoir and in which a screw adapted to stir, transfer and collect ink is rotatively mounted therein, an ink delivery section for delivering ink into the ink reservoir, and a pump installed between the ink steering/collecting section and the ink delivery section. A suction port of the pump is directly connected to an ink collecting zone of the ink steering/collecting section where ink is collected through the action of the screw.

9 Claims, 5 Drawing Sheets 101 363

INK FOUNTAIN APPARATUS

BACKGROUND OF THE INVENTION

1. Field of the Invention

This invention relates to an ink fountain apparatus for use with a printing press adapted to store always a predetermined amount of ink supplied by an ink supply unit in an ink fountain thereof.

2. Description of the Prior Art

As ink fountain apparatuses, there are publicly known, for example, those described in Japanese Laid-Open Utility Model Application Nos. SHO 64-1939 and SHO 63-18244.

The ink fountain apparatus shown in Japanese Laid-Open Utility Model Application No. SHO 64-1939 comprises an ink fountain located below a fountain roller; an ink nozzle mounted in the ink fountain so as to be oriented to the peripheral surface of the fountain roller; an ink supply conduit connecting the ink fountain with the ink nozzle; a pump mounted in the ink supply conduit; and an ink stirring conduit branched downstream of the pump in the ink supply conduit and connected to the bottom of the ink fountain, the arrangement being made such that the ink stored in the ink fountain can be supplied by the pump into the ink nozzle through the ink supply conduit, and as occasion demands, a stirring effect can be given to ink by circulating it through the ink stirring conduit.

Further, Japanese Laid Open Utility Model Application No. SHO 63-18244 discloses an ink tank apparatus wherein the ink stored in an ink tank is collected through the action of a screw, and the ink thus collected is supplied by a pump into an ink delivery nozzle mounted opposite to an ink supply roller through an ink supply conduit, and a surplus amount of ink is recovered into the ink tank.

It is known that pressure loss $\Delta P$ which occurs when a fluid having a viscosity $\mu$ is pressurized by a pump and transferred in a laminar flow through a pipe having a diameter "D" and a length "l" is represented by a formula $\Delta P = 128\ \mu l Q/\pi D^4$ wherein Q is the flow rate of the fluid. Stating in brief, it is known that the higher the viscosity of the fluid, and the longer the length of the pipe, and further the more the flow rate of the fluid, the higher the pressure loss becomes thus rendering the fluid transfer difficult, whilst the larger the pipe diameter, the lower the pressure loss becomes.

In the above-mentioned ink fountain apparatuses, however, all passages through which the ink stored in an ink reservoir section is transferred by a pump and which extend between the ink reservoir section and the pump and also between the pump and an ink receiving section are formed by conduits having small diameters. Therefore, in order to ensure that a sufficient amount of ink is delivered by the nozzle, the provision of a pump having a comparatively large capacity capable of covering such a pressure loss in the pipe and a driven unit having a relatively large capacity was required, and also it was necessary to provide a comparatively large space for installation of pipings. Therefore, it was difficult to make the configuration of the above-mentioned ink fountain apparatus small-sized and compact.

Still further, the use of a pump in the condition that relatively high pressure losses occur has expedited damage of the pump, thus reducing the life-time thereof.

Whilst, as ink fountains, there are publicly known those described in Japanese Laid-Open Patent Application Nos. SHO 35-12862, SHO 39-5717 and SHO 59-393.

These publicly known ink fountains are arranged such that the ink supplied from an ink tank provided separately in an amount more than the actual consumption is caused to overflow from an intermediate partition so that a pre-determined amount of ink can always be stored therein. And, the level of the ink stored in the ink fountain is arranged to be kept lower than end shafts of a roller which is rotated while it is partially immersed in the ink in the ink fountain.

As described above, since the level of the ink stored in the prior art ink fountain is arranged to be kept lower than end shafts of a roller which is rotatively driven while it is partially immersed in the ink in the ink fountain, only less than the half of the peripheral surface of the above-mentioned roller is immersed in the ink in the ink fountain. Therefore, the ink which is desposited on the peripheral surface of the roller while it is partially immersed in ink and which comes out of the surface of ink, as the roller is rotated, tends to drop from the peripheral surface owing to mechanical vibrations, etc. during its passage to a downstream roller which is engaged with or located close to the fountain roller. This caused fluctuations in the amount of ink to be supplied to the above-mentioned downstream roller so that uniform quality of printing could not be achieved. Further, in worst cases, a sufficient amount of ink required for printing could not be supplied. Such difficulties have frequently occurred when dampening water made ingress into the ink supply passage in lithography using a highly viscous ink and dampening water.

SUMMARY OF THE INVENTION

The present invention has been devised in view of the above-mentioned circumstances and to solve various problems encountered in the prior art, and has for its first object to provide an ink fountain apparatus wherein the length of the ink supply conduit in the ink supply system is substantially reduced.

Another object of the present invention is to provide an ink fountain apparatus wherein the distance over which the peripheral surface of a fountain roller immersed in the ink stored in an ink fountain is moved after it comes out of the surface of ink as it is rotated, until it comes into contact with a downstream roller located downstrem of the ink supply passage; that is; the ink deposited thereon is supplied or transferred to the downstream roller is reduced.

To achieve the above-mentioned objects, according to a first aspect of the present invention, there is provided an ink fountain apparatus in an ink supply system for use with a printing press comprising: an ink reservoir provided with an ink fountain; an ink stirring and collecting section form in a zone of the ink reservoir section and in which a screw adapted to stir, transfer and collect ink is rotatively mounted therein; and an ink delivery section adapted to deliver ink into the ink reservoir section in which it is stored; and a pump installed between the ink stirring and collecting section and the ink delivery section, the suction port of the pump being directly connected to an ink collecting zone of the ink stirring and collecting section where ink is collected through the action of the screw.

According to a second aspect of the present invention, there is provided an ink fountain apparatus as set forth in the above-mentioned first aspect, characterized in that the ink fountain comprises an intermediate plate mounted in the vicinity of the peripheral surface of a fountain roller on the side wherein it comes out of the surface of ink stored in the ink reservoir section as it is rotated, the top edge of the intermediate plate being always kept higher than the level of the ink stored in the ink reservoir section.

According to the present invention incorporating the above-mentioned aspects, when the screw is rotated, the ink stored in the ink reservoir section is transferred to the ink collection zone where the leading end of the screw is located and collected there. And, the pump whose suction port is directly connected to the leading end of the screw will draw in the ink thus collected and discharge it into the ink delivery section. The ink delivered by the ink delivery section is stored in the ink reservoir section.

During the above-mentioned process, turbulent flow of ink is casued by the transfer and collecting action of the screw thus giving a stirring effect to ink.

As a result, the pressure loss of ink which occurs when it is supplied through ink conduits is reduced so that the capacity of the pump for supplying ink can be reduced, and hence the capacity of the driver unit can also be reduced correspondingly, thus achieving a considerable reduction in the space required for installing the ink supply system for use with a printing press. Further, the above-mentioned reduction in the pressure loss will reduce the loading on the pump and hence the damage of the pump so that the frequency of maintenance and repairs of the pump can be reduced, thus increasing the life-time thereof.

Further, in the supply of ink by rotating the fountain roller partially immersed in ink stored in the ink fountain, the frequency of dropping of ink during the period wherein the peripheral surface of the fountain roller comes out of the surface of ink and then reaches a supply position where the ink deposited thereon is supplied to the peripheral surface of the downstream roller is remarkably reduced. Further, even if such dropping of ink occurs, recovery to the original conditions will be made so that the fluctuations in the amount of ink to be supplied to the downstream roller can be reduced to such a degree which does not affect the quality of printing. Still further, the rise of the level of ink in the space between the peripheral surface of the fountain roller and the intermediate plate becomes enhanced particularly with highly viscous ink. Therefore, an improved effect could be achieved in lithoprinting using ink having a comparatively high viscosity which has caused difficulties in use, and also dampening water.

The above-mentioned and other objects, aspects and advantages of the present invention will become apparent to those skilled in the art by making reference to the following detailed description and the accompanying drawings in which preferred embodiments incorporating the principles of the present invention are shown by way of example only.

DETAILED DESCRIPTION OF THE PREFERRED EMBODIMENTS

The present invention will now be described in detail below by way of several preferred embodiments thereof with reference to the accompanying drawings.

Figure 2:
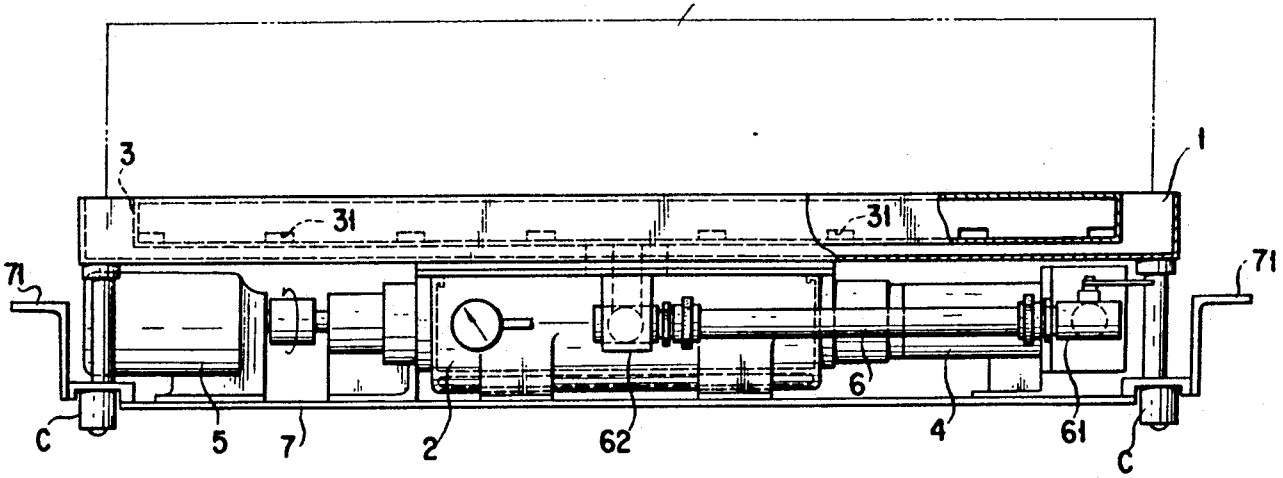
FIG. 2 is a schematic front view of the embodiment shown in FIG. 1.
Figure 3:
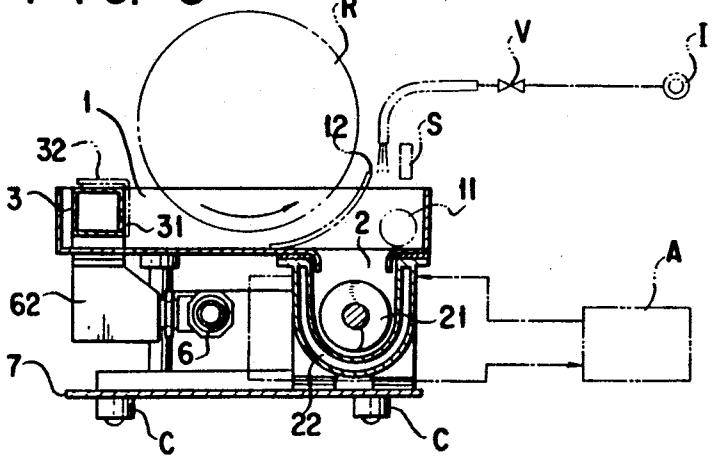
FIG. 3 is a sectional view taken along line III—III in FIG. 1.

In the first place, an ink fountain apparatus of the present invention will be described with reference to FIGS. 1 to 3.

This ink fountain apparatus comprises an ink reservoir section including an ink fountain adapted to store ink in which a fountain roller R out of a group of inking rollers (not shown) for use in a printing machine, not shown; an ink stirring and collecting section 2 formed by projecting a portion of the bottom part of the ink reservoir section 1 downwardly and having a screw 21, adapted to be rotatively driven by a driver, installed therein; a pump 4 whose suction port is directly connected to a zone in the ink stirring and collecting section 2 where ink is collected through the action of the screw 21 and whose discharge port is connected by a piping system to an ink delivery section 3 which will be described below; and the ink delivery section 3 arranged to deliver the ink supplied by the pump 4 through ink delivery parts 31, 31 . . . into the ink reservoir section 1. The ink fountain apparatus 1 is fixedly mounted, for example, on a bed 7.

Further, the ink stirring and collecting section 2 has a hollow section 2 which is formed integrally on the outer wall thereof and through which a constant temperature fluid to maintain the temperature of the ink stored in the ink fountain apparatus at an approximately predetermined value is circulated by a constant temperature fluid circulation system "A" which can be connected and disconnected by a plug, not shown. Further, in the embodiment shown, the pump 4 has a rotor shaft whose one end passes through the suction port and is connected to the shaft of the screw 21 so that it can be driven by the driver or prime mover 5 through the shaft of the screw 21. Therefore, the pump driving system is shown as having an extremely compact configuration. However, the screw 21 and the pump 4 may be driven by separate or different drivers, respectively, or as an alternative, a pump of a different type (not shown) may be used to achieve the same purpose.

In the above-mentioned arrangement, ink is stored up to a predetermined range of level in the ink reservoir section 1, and also the ink fountain apparatus is mounted on a printing machine (not shown) in such a manner that the fountain roller R is partially immersed in the ink stored in the ink reservoir section 1 and can be rotated therein. In case, as in the embodiment shown, the bed 7 is provided with casters C and can be independently moved relative to the printing machine, not shown, for example, mounting members 71 are engaged with a proper elevator means (not shown) mounted on the printing machine so that the fountain apparatus is lifted to a predetermined position and fixed there.

Subsequently, the driver means 5 is actuated or rotated in a direction as shown, for example, by arrow in FIG. 2. As a result, the ink in the ink stirring and collecting section 2 is transferred and collected by the screw 21 towards the right hand side of the section 2 in FIG. 1. During this ink transfer and collection, a turbulent flow of ink will take place thus giving a stirring effect to the ink.

The ink which has thus been transferred and collected is drawn in by the pump 4 whose suction port is located in the ink collection zone, and then supplied through an ink supply conduit 6, which is the only one conduit in the embodiment shown, a valve 61 and a piping block 62 into the ink delivery section 3. The ink which has flown into the ink delivery section is delivered through the ink delivery ports 31, 31 . . . into the ink reservoir section 1 in which it is stored. In case it is desired to regulate the amount of the ink to be delivered through each of the ink delivery ports 31, 31 . . . , each of the delivery ports 31 may be provided with a shutter 32 as shown by two-dot chain lines in FIG. 3 so as to enable the degree of opening of each of the delivery ports 31 to be regulated. Further, ink will always flow from the ink reservoir section 1 into the ink stirring and collecting section 2 by an amount which is equivalent to that of the ink which is transferred and collected by the screw 21 in the section 2 and then supplied by the pump 4 into the ink delivery section 3.

Stating in brief, when the driver means 5 is actuated, the ink stored in the ink fountain apparatus is caused to circulate, in turn, through the ink stirring and collecting section 2, the pump 4, the ink supply conduit 6, the ink delivery section 3, the ink reservoir section 1 and then back to the ink stirring and collecting section 2. In case, during this ink circulation, the ink flow in both the left and right hand zones of the ink reservoir section 1 is inferior to those in the remaining zone, it is desirable to mount an auxiliary screw 11 as shown by two-dot chain lines in FIG. 3 so that it may be driven, and to transfer and collect ink in both the left and right hand sides of the ink reservoir section 1 to the central zone thereof.

Whilst, when the printing press (not shown) is operated, ink in the ink fountain apparatus is supplied by the fountain roller R into the printing machine and consumed thereby. To cope with the reduction of ink by consumption, arrangement is made such that a lower limit of the level of ink is detected by an ink level sensor means S provided appropriately so as to generate a detection signal, and a valve V is opened by the detection signal to thereby supply ink from an ink supply source 1 into the ink reservoir section 1. A signal for closing the valve V is generated by the ink level sensor means S when the upper limit of ink level is detected by the latter.

The ink in the ink reservoir section 1 is maintained by the above-mentioned operation at an approximately uniform property and at an approximately predetermined range of level so that a stable supply of ink to the upstream roller R which is rotated while it is partially immersed in ink can be achieved. Further, it is effective for the stabilization of the property of ink to maintain the temperature of the ink approximately constant by causing a constant temperature fluid to be circulated through the hollow portion 22 formed on the outer wall of the ink stirring and collecting section 2. Further, if and when ink is supplied by the above-mentioned ink supply source 1 directly into the ink stirring and collecting section 2, then the intermixing of the supplied ink with that stored in the ink reservoir is enhanced appreciably.

Figure 1:
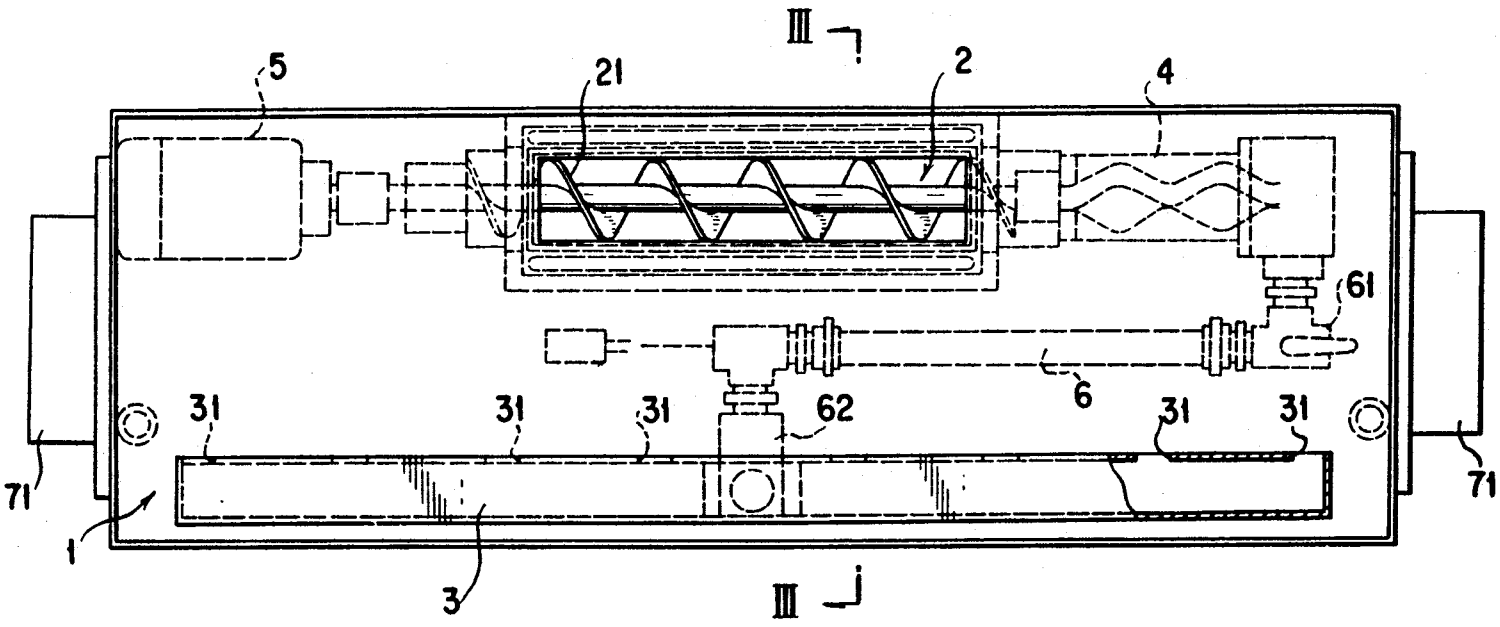
FIG. 1 is a schematic plan view showing one embodiment of the ink fountain apparatus according to the present invention.

Further, an intermediate plate 12 as shown by two-dot chain lines in FIG. 1 is a weir adapted, during rotation of the fountain roller R, to rise the level of ink on the side wherein the upstream roller R comes out of the surface of ink. This intermediate plate 12 has notches or holes formed therethrough at a level lower than the level of the ink stored therein, or alternatively, so as to extend from an upper level higher than the level of ink to a lower level lower than the level of ink to thereby enable communication of ink between the two zones of the ink reservoir section 1 separated thereby to be made without impeding the ink circulation in the ink fountain apparatus. Such notches or through-holes may be provided properly as occasion demands.

In the next place, several embodiment of the ink fountain used in the above-mentioned ink fountain apparatus will be described with reference to FIGS. 4 to 10.

Figure 4:
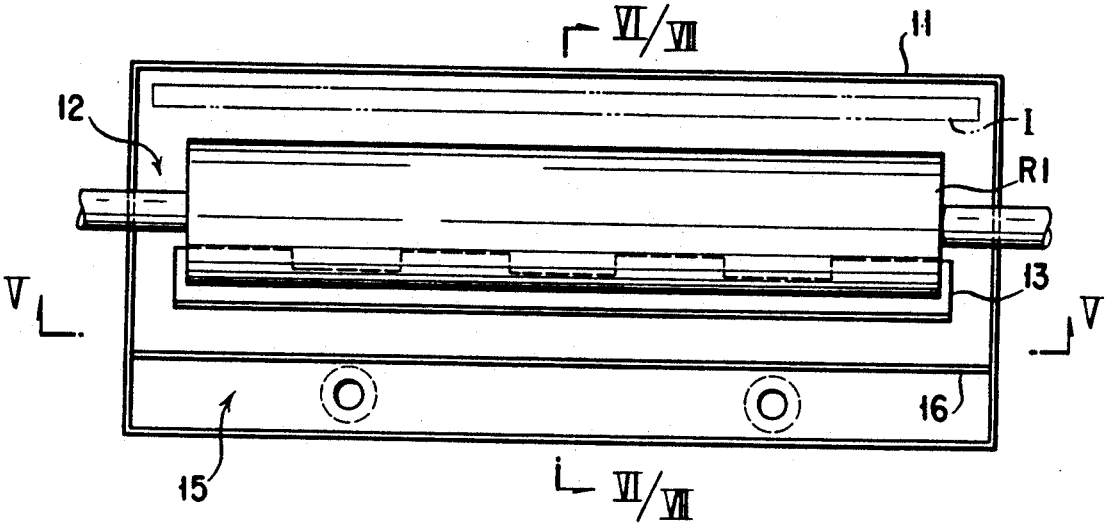
FIG. 4 is a schematic plan view showing one embodiment of the ink fountain apparatus according to the present invention.
Figure 6:
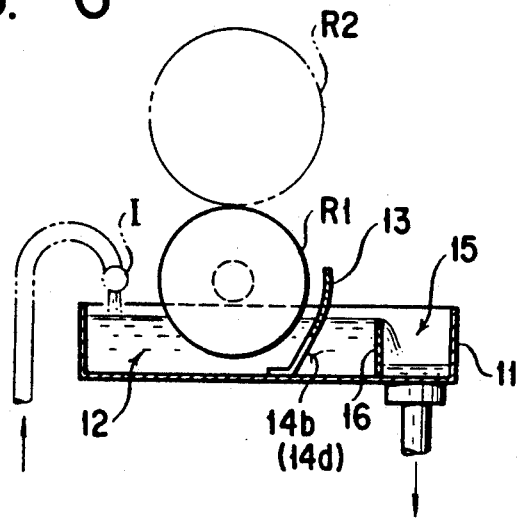
FIGS. 6 and 7 are sectional views taken along lines VI—VI and VII—VII, respectively, FIG. 6 showing a fountain roller in non-rotating condition, whilst FIG. 7 showing the same in rotating condition.
Figure 7:
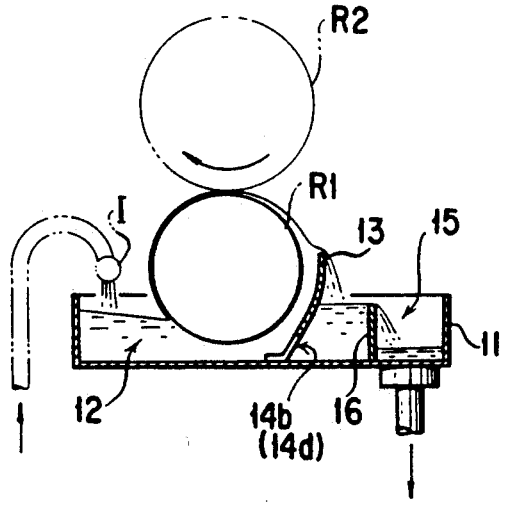
Figure 8:
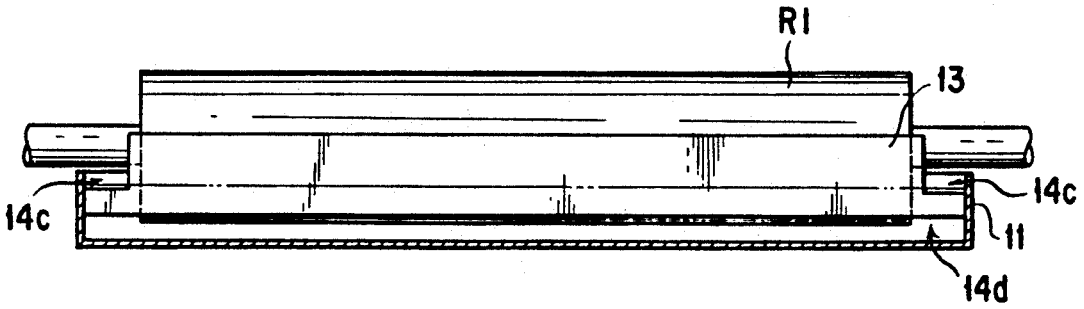
FIGS. 8 and 9 are front views of principal parts showing other embodiments of the ink fountain apparatus having intermediate plates whose configurations are different from that of the intermediate plate used in the embodiment of FIG. 4.
Figure 10:
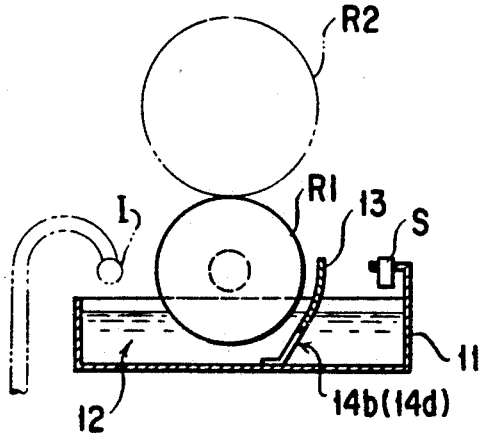
FIG. 10 is a schematic sectional view showing a side portion of a further embodiment of the ink fountain according to the present invention.

An ink fountain 11 has an ink reservoir section 12 capable of storing ink at an approximately predetermined range of level in which a fountain roller R1 is partially immersed. The ink reservoir section 12 has an intermediate plate 13 located at a position close to the peripheral surface of the fountain roller R1 on the side wherein the roller $R_1$, comes out of the surface of ink when it is rotated, and which has a sectional shape corresponding approximately to that of the fountain roller R1. This intermediate plate 13 is somewhat longer than the length L of the surface of press plate to be supplied with ink in the lengthwise direction of the peripheral surface of the fountain roller R1, nad is arranged such that the leading edge thereof may project out of the surface of ink when the ink reservoir section 12 is filled with ink up to the above-mentioned approximately predetermined level. Further, the intermediate plate 13 has communication means 14 such as notches and/or through-holes formed at least in the portion thereof to be submerged in ink. Further, in case the intermediate plate 13 is installed in such a manner that both ends thereof are kept in contact with the inner surface of the outer wall of the ink fountain 11, it is preferable to make the height of the top edges of the intermediate plate 13 on both sides thereof lower than the height of the top edge of the outer wall of the ink fountain 11, as shown in FIG. 8, to prevent overflow of ink along the intermediate plate 13 and outside of the ink fountain 11 from accurring. As a means for keeping the level of the ink to be stored in the ink reservoir section 12 within an approximately predetermined range, an intermediate partition strip 16 is provided, as shown in FIGS. 4, 6 and 7, to divide the interior of the ink fountain 11 into an ink reservoir section 12 and an ink delivery section 15 and keep the height thereof lower than that of the outer wall of the ink fountain 11. The arrangement is made such that the ink reservoir section 12 is always supplied with ink by the ink supply unit I, and the ink which overflows the intermediate partition strip 16 into the delivery section 15 may be recovered from the latter and supplied again into the ink reservoir section 12. Alternatively, it is possible to detect the level of ink by means of a level sensor S, as shown in FIG. 10, and to conduct intermittently supply of ink from the ink supply unit I in response to the detection of predetermined upper and lower limits of ink level by the level sensor. As a further alternative, use of the above-mentioned two methods in combination may be made, or other proper means may be used.

The supply of ink by the above-mentioned ink fountain 11 is made as follows.

The ink fountain 11 is combined appropriately with a printing press, not shown, in such a manner that fountain roller R1 may be partially immersed in ink when it is filled with ink. In this condition, the fountain roller R1 is rotated in a direction as shown by arrow in FIG. 7. Thereupon, the ink deposited on the peripheral surface of the portion of the fountain roller R1 immersed in ink comes out of the surface of ink as it is when the roller R1 is rotated, and is transferred onto a downstream roller R2 which is engaged with or located close to the fountain roller R1. In that case, at a position where the fountain roller comes out of the surface of ink, ink will rise since it is guided endlessly by the fountain roller R1, and at length the trailing end of the rising ink will reach the intermediate plate 13 mounted close to the fountain roller R1. Consequently, formed in the space enclosed by the peripheral surface of the fountain roller R1 and the intermediate plate 13 is a new ink surface which is supported by both the peripheral surface of the fountain roller R1 which is displaced upwardly by the rotation thereof and the intermediate plate 13 and which is higher than the level of ink in the remaining section. When the formation of this new ink surface continues, the new ink surface will reach the leading edge of the intermediate plate 13, as shown in FIG. 7, so that the portion of the peripheral surface of the fountain roller R1 which comes out of the surface of ink in the ink revervoir section 12 is kept to be immersed in ink up to a position higher than the normal level of ink stored in the ink reservoir section 12. Therefore, the distance over which the peripheral surface of the fountain roller R1 immersed in ink is moved after it comes out of the surface of ink until the ink deposited thereon is supplied or transferred to the peripheral surface of the downstream roller R2 is reduced substantially. As a result, a marked reduction in the frequency of dropping of ink from the peripheral surface of the fountain roller R occurs, and even if dropping of ink takes place, the distance over which ink drops is short, and so quick recovery to the original conditions will be made quickly.

Figure 5:
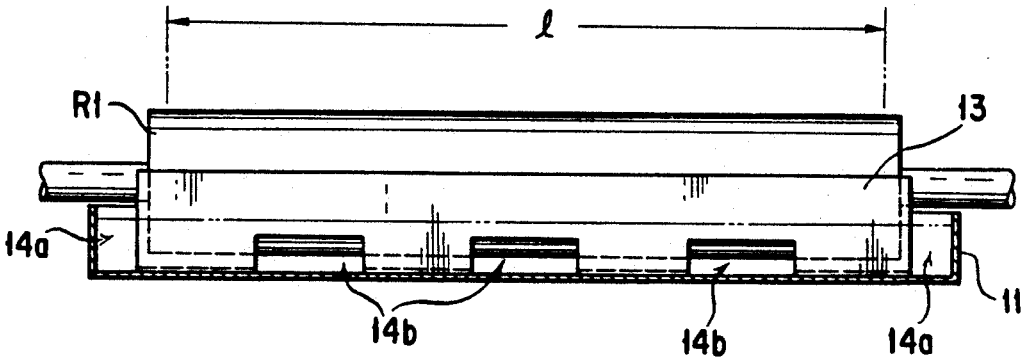
FIG. 5 is a sectional view taken along line V—V in FIG. 4.
Figure 9:
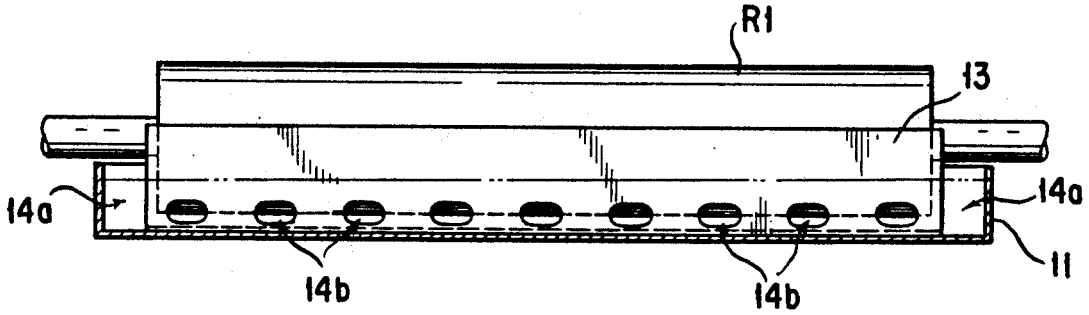

Whilst, the lower edge of the intermediate plate 13 is located at a position lower than normal level of ink stored in the ink reservoir section 12. And, as shown in FIGS. 5 and 9, both left and right side portions of the intermediate plate 13 are each cut off by a predetermined lengthwise width so as to form first communication openings 14*a* therein, and also second communication openings 14*b* comprised of a plurality of notches and/or through-holes in the lower part of the intermediate plate 13 located below the level of the ink stored in the ink reservoir section 11. As shown in FIG. 8, the above-mentioned first communication openings 14*a* may be comprised of notches 14*c* formed by cutting off both left and right side portions of the intermediate plate 13 so as to keep both cut-off side portions somewhat lower than the level of the ink in the ink reservoir section 11. Further, the above-mentioned second communication openigns 14*b* may be compirsed of a continuous hole 14*d* formed by cutting off the intermediate plate 13 by a predetermined lengthwise width. Consequently, there is almost no hindrance to the flow of the ink supplied by the ink supply unit I within the ink reservoir section 12. Further, in FIGS. 5, 8 and 9, respectively, the level of the ink stored in the ink reservoir section 11 is indicated by two-dot chain lines. In consequence, the level of the ink stored in the ink reservoir section 12 is not subject to large influences by the fluidity of the ink and by whether the fountain roller R1 is rotating or not. Stating in brief, there is no possibility of occurrence of marked changes in the level of the ink stored in the ink reservoir section 12 of the ink fountain 11 with the exception of the level of ink to be created in the space between the fountain roller $R_1$ and the intermediate plate during rotation of the roller R1.

It is to be understood that the foregoing description is merely illustrative of preferred embodiments of the present invention, and that the present invention is not to be limited thereto, but is to be determined by the scope of the appended claims.

What is claimed is:

1. An ink fountain apparatus in an ink supply system for use with a printing press, comprising:

an ink reservoir section provided with an ink fountain section having an outer wall;

an ink stirring and collection section having an ink collecting zone formed in a zone of the ink reservoir section;

a screw located and rotatively mounted in said ink stirring and collecting section and which is structurally adapted to stir, transfer and collect ink an ink delivery section cooperating with said ink reservoir section and adapted to deliver ink into said ink reservoir section in which it is stored;

a pump located between said ink stirring and collecting section and said ink delivery section, said pump having a suction port directly connected to an ink collecting zone of the ink stirring and collection section where ink is collected through the action of said screw;

a rotatable fountain roller having a peripheral surface, at least a portion of which is immersed in ink stored in the ink reservoir section; and an intermediate plate mounted in a close vicinity of the peripheral surface of the fountain roller wherein the fountain roller exits from the surface of ink stored in the ink reservoir section as the fountain roller is rotated, a top edge of the intermediate plate being located higher than a level of ink stored in the ink reservoir section, and a bottom edge of the intermediate plate being kept lower than the lever of ink.

2. An ink fountain apparatus as claimed in claim 1, wherein said intermediate plate has first communication means formed in a zone thereof below the source of the ink stored in the ink reservoir section.

3. An ink fountain apparatus as claimed in claim 1, wherein the height of the top edge of said intermediate plate on each lengthwise side thereof is lower than the height of the top edge of the outer wall of said fountain and also lower than the level of the ink stored in the ink reservoir section so as to form first communication means in the intermediate plate.

4. An ink fountain apparatus as claimed in claim 3, wherein said first communication means is comprised of a plurality of notches formed in the bottom edge of said intermediate plate.

5. An ink fountain apparatus as claimed in claim 3, wherein said first communication means is comprised of a plurality of through-holes formed in the bottom edge of said intermediate plate.

6. An ink fountain apparatus as claimed in claim 3, wherein said first communication means is a lengthwise elongated hole defined by cutting off the lower part of said intermediate plate.

7. An ink fountain apparatus as claimed in claim 1, wherein said intermediate plate has first communication means formed in a zone thereof below the surface of the ink stored in the ink reservoir section, and both left and right side portions of said intermediate plate are each terminated by a predetermined lengthwise width to form second communication means.

8. An ink fountain apparatus as claimed in claim 7, wherein said first communication means is comprised of a plurality of notches formed in the bottom edge of said intermediate plate.

9. An ink fountain apparatus as claimed in claim 7, wherein said first communication means is comprised of a plurality of through-holes formed in the bottom edge of said intermediate plate.

* * * * *